US007318251B2

(12) United States Patent
Lin

(10) Patent No.: US 7,318,251 B2
(45) **Date of Patent: *Jan. 15, 2008**

(54) SAFETY BUCKLE OF CURTAIN

(75) Inventor: Tzong-Fu Lin, Taipei (TW)

(73) Assignee: Lewis Hyman, Inc., Carson, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/337,004

(22) Filed: Jan. 23, 2006

(65) Prior Publication Data

US 2006/0117526 A1 Jun. 8, 2006

Related U.S. Application Data

(63) Continuation of application No. 10/436,178, filed on May 13, 2003, now Pat. No. 7,017,230.

(51) Int. Cl.
*E05B 9/30* (2006.01)

(52) U.S. Cl. ..... 16/202; 160/178.1 R; 160/168.1 R; 160/243; 24/115 F; 24/602

(58) Field of Classification Search ..... 16/202, 16/203; 24/602, 115 F, 130, 155 A, 462; 160/178.1 R, 178.1 V, 173 R, 173 V, 243, 160/405, 168.1 R; 403/232.1, 235, 371, 403/34, 210, 213

See application file for complete search history.

(56) References Cited

U.S. PATENT DOCUMENTS 4,909,298 A 3/1990 Langhart et al. ..... 160/178.1 R
5,485,875 A 1/1996 Genova ..... 160/168.1 R
5,518,056 A 5/1996 Voss ..... 160/178.1 R
5,542,462 A 8/1996 Elsenheimer et al. . 160/178.1 R
5,560,414 A 10/1996 Judkins et al. ..... 160/178.1 R
5,577,543 A * 11/1996 Jelic ..... 160/178.1 R
5,675,875 A 10/1997 Servatius ..... 24/704.1
5,771,843 A * 6/1998 Karlin ..... 119/772
5,987,709 A * 11/1999 Chou ..... 24/116 A
6,431,248 B1 8/2002 Hyman et al. ..... 160/178.1 R
6,591,461 B2 7/2003 Salentine et al. ..... 24/115 F
6,682,249 B2 1/2004 Rietz ..... 403/2
7,017,230 B2 * 3/2006 Lin ..... 16/202

* cited by examiner

*Primary Examiner*—Chuck Y. Mah
(74) *Attorney, Agent, or Firm*—Akerman Senterfitt

(57) ABSTRACT

A safety buckle of a curtain comprises a curtain body and an upper beam; an auto slide-stop installed within the upper beam for controlling the curtain body to a predetermined position; and a control rope set having a first end and a second end which are at opposite sides. The first end is a rope and the second end. The safety buckle comprises a male pin having a body portion and a guide end. The body portion is positioned at a bottom of the guide end and is connected to a distal end of the rope. A female pin is firmly secured to the upper beam and has a pin seat. The pin seat is formed with a hollow guide hole. When the ropes are pulled, the male pin is separated from the female pin so that the upper beam and the ropes are in a safe state.

4 Claims, 6 Drawing Sheets

SAFETY BUCKLE OF CURTAIN

CROSS-REFERENCE TO RELATED APPLICATIONS

This application claims priority to and is a continuation of U.S. patent application entitled, SAFETY BUCKLE OF CURTAIN, filed May 13, 2003, having a Ser. No. 10/436,178, now U.S. Pat. No. 7,017,230, the disclosure of which is hereby incorporated by reference in its entirety.

FIELD OF THE INVENTION

The present invention relates to safety buckles, and particularly to a safety buckle for buckling or separating a rope and an upper beam. When a rope is pulled, the male pin will be acted so as to separate from the female pin so as to avoid a mistake from occurring.

BACKGROUND OF THE INVENTION

Referring to FIGS. 1A and 1B, a prior art curtain is illustrated. The curtain has an upper beam 1, a curtain body 2 and a control rope set 3. The upper beam has a front receiving chamber 4 and a rear receiving chamber 5. The front receiving chamber 4 can be embedded by the curtain body 2 so as to be connected to the upper beam. Another end of the curtain body 2 suspends downward. The rear receiving chamber 5 is arranged with an auto slide-stop 6 and a pulley 7. One end of the control rope set 3 is a rope 8, and another end is a rope 9. The rope 8 stops at a predetermined position by the auto slide-stop 7. The rope 9 winds around the curtain body 2. A distal end A of the rope 9 is embedded into the front receiving chamber 4 so that the rope 9 is combined to the upper beam. By pulling the rope 8, the curtain 2 can be wound upwards.

When the rope 9 winds around the curtain 2, the rope 9 will form a circle. Generally, children can not know the danger of the circle. Once the circle encloses the neck of the child, and the rope 8 is pulled, the rope 9 will move upwards. As a result, an accident occurs. This is because no safety structure exists between the rope 9 and the upper beam. Thereby, this prior art is dangerous at home and necessary to be improved.

SUMMARY OF THE INVENTION

Accordingly, the primary object of the present invention is to provide a safety buckle of a curtain including a male pin and a female pin; when a rope is pulled, the male pin will be acted so as to separate from the female pin to avoid an mistake from occurring.

Another object of the present invention is to provide a safety buckle of a curtain, wherein the male pin has a pin seat; the pin seat being formed with a hollow guide hole and an open groove. The male pin has a dome shape guide end. The guide end can be enforced into the hollow guide hole by the open groove. Therefore, when the guide end is pulled, the male pin can be separated from the guide end by the open groove so that the male pin separates from the female pin.

To achieve above object, the present invention provides a safety buckle of a curtain comprises a curtain body and an upper beam, a distal end of the curtain body being connected to the upper beam; an auto slide-stop being installed within the upper beam for controlling the curtain body to a predetermined position; and a control rope set having a first end and a second end which are at opposite sides. The first end is a rope and the second is also a rope which are interacted so as to control the curtain body to be folded upwards or to be released downward. The various objects and advantages of the present invention will be more readily understood from the following detailed description when read in conjunction with the appended drawing.

BRIEF DESCRIPTION OF THE PREFERRED EMBODIMENTS

Figure 1A:
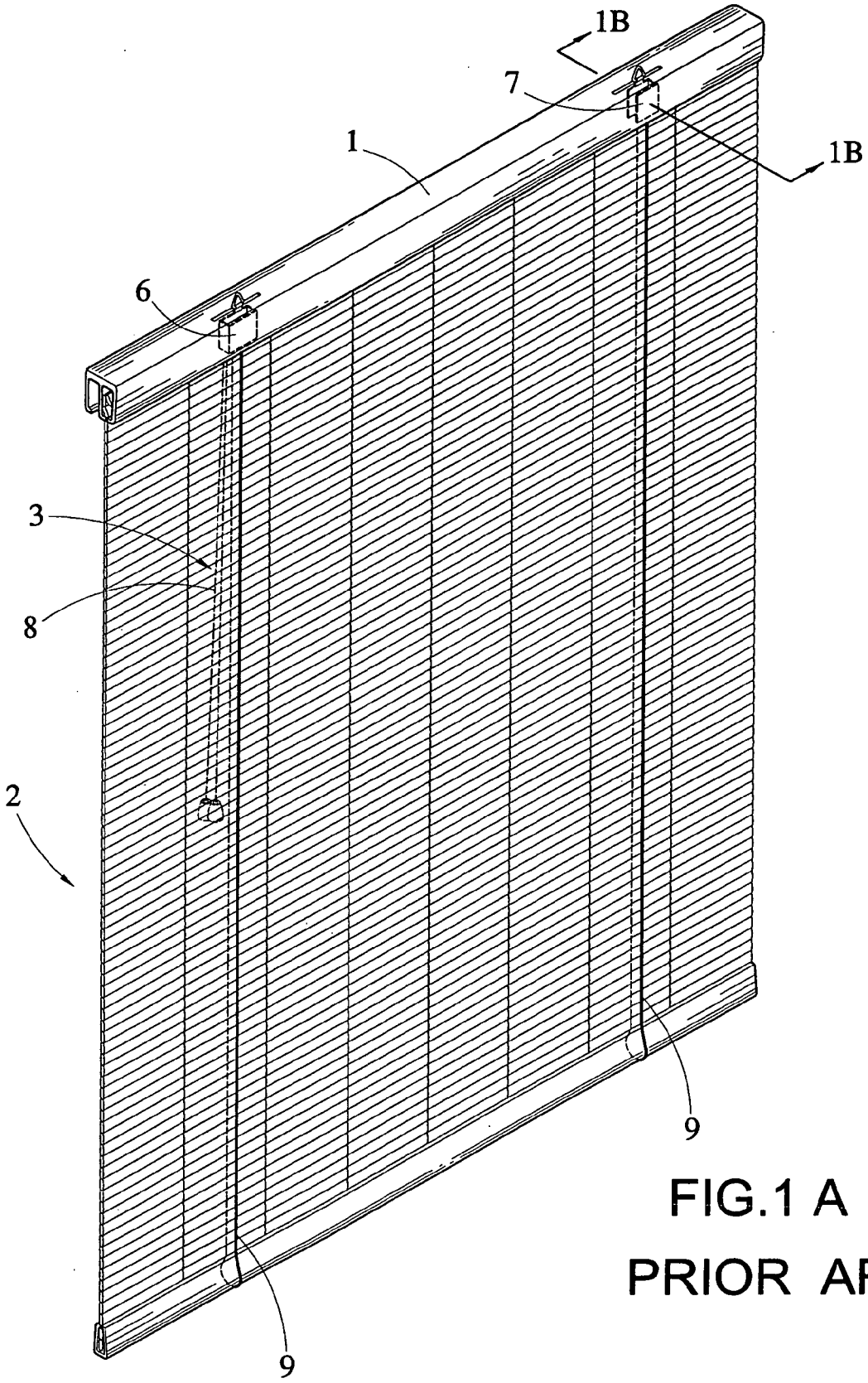
FIG.1 A PRIOR ART
FIG. 1A is a perspective view of a prior art curtain.
Figure 1B:
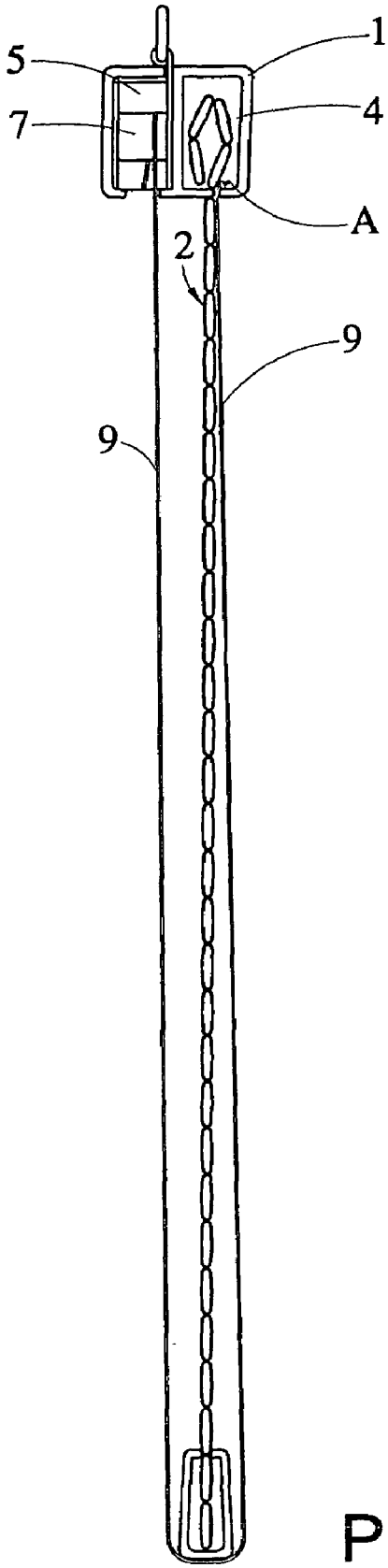
FIG.1 B PRIOR ART
FIG. 1B is a cross-section view along line 1B-1B of FIG. 1A.
Figure 2:
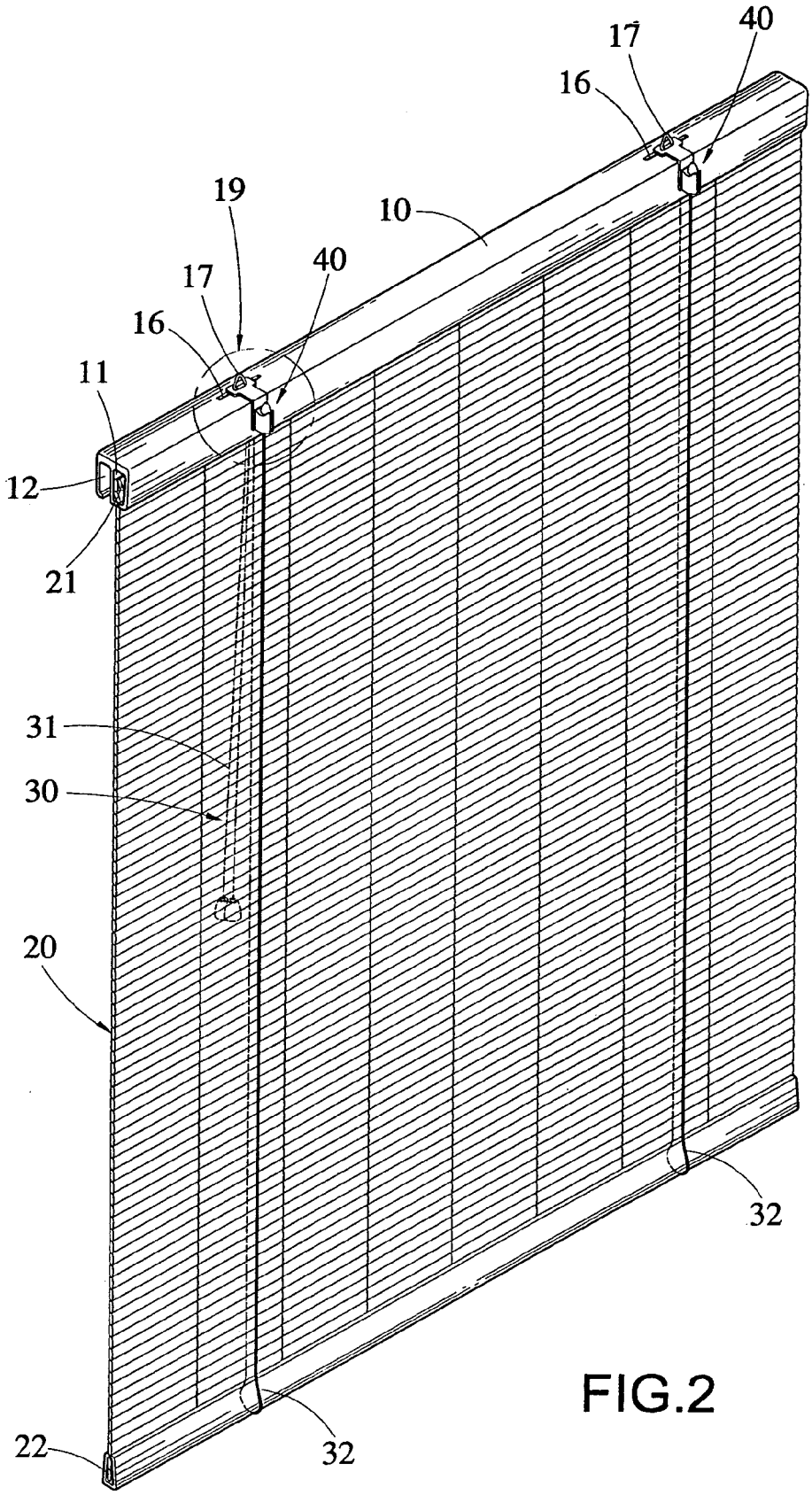
FIG. 2 is a perspective view of the curtain of the present invention.
Figure 3:
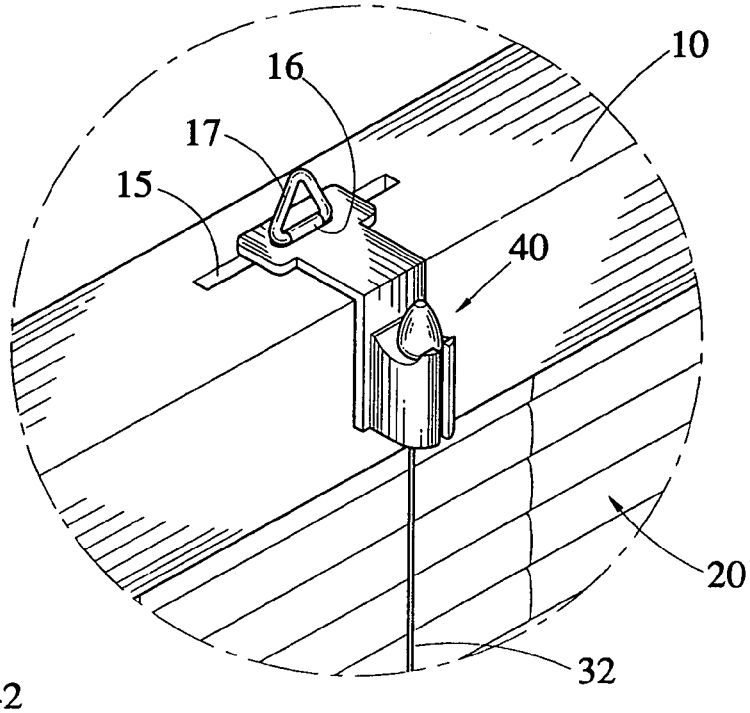
FIG. 3 is a partial enlarged view showing the section indicated by the dashed line 19 of FIG. 2.
Figure 4:
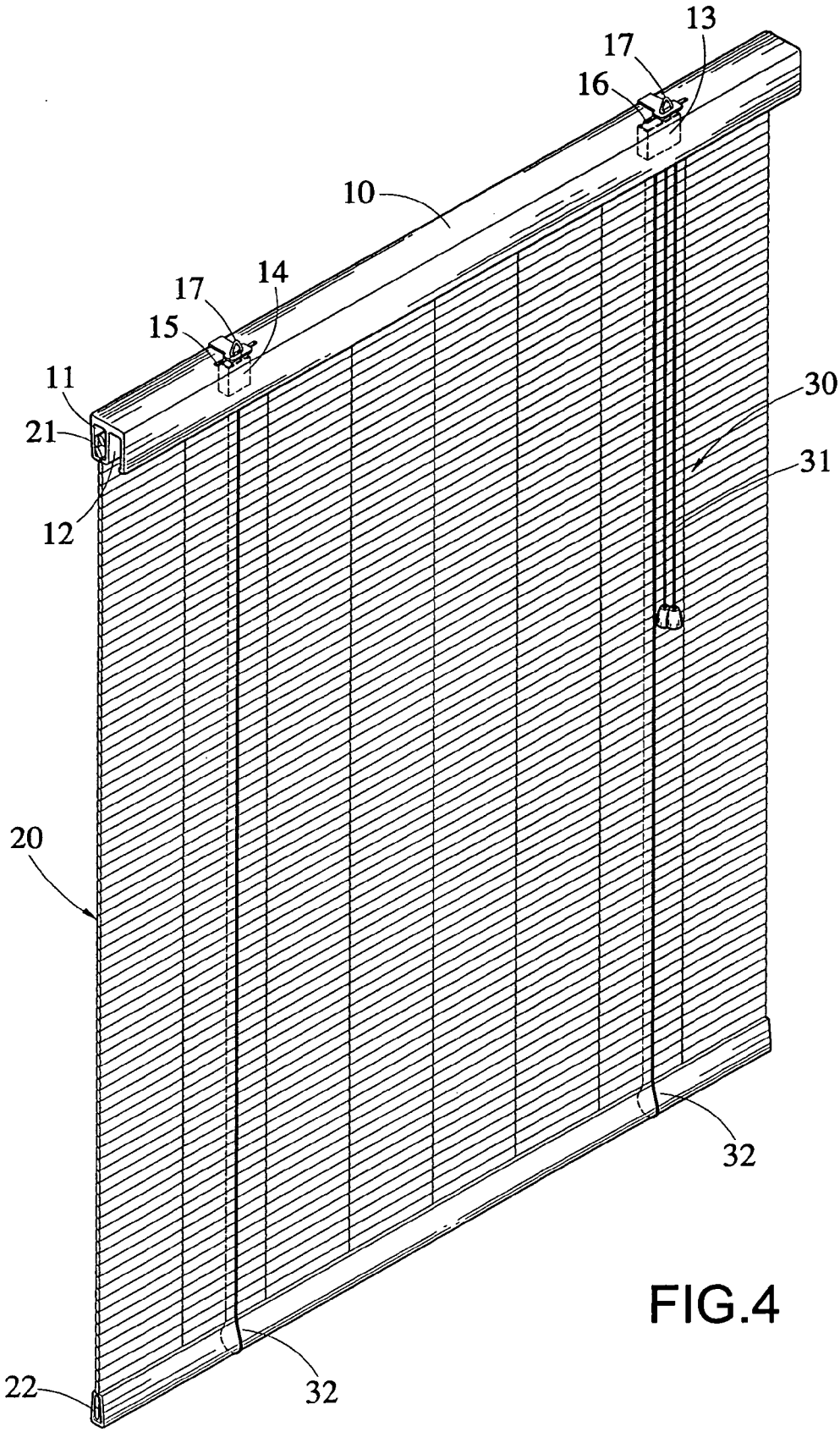
FIG. 4 is a rear view of the curtain of the present invention.

Referring to FIGS. 2 to 4, the safety buckle of a curtain of the present invention includes an upper beam 10 which can be suspended to a window frame, a plastic curtain body 20, a control rope set 30 for controlling the rising and descending of the curtain body 20 and a safety buckle 40.

The interior of the upper beam 10 has a front receiving chamber 11 and a rear receiving chamber 12. The front receiving chamber 11 can be buckled with a front receiving chamber 11 of the curtain body 20 to be connected to the upper beam 10. The second end 22 of the curtain body 20 is suspended downwards. A sliding element is arranged in the rear receiving chamber 12. The sliding element includes an auto slide-stop 13 and a pulley 14. A top of the upper beam 10 has two long holes 15. A stopper 16 passes through one long hole 15 to be combined with the auto slide-stop 13 and the pulley 14. A hook 17 is engaged to the stopper 16. By the hook 17, the upper beam 10 can be suspended to a window frame.

A first end of the control rope set 30 is a rear rope 31 and the first end thereof is also a rope 32. The rope 31 can stop the curtain body 20 at a predetermined position through the auto slide-stop 13. The rope 32 protrudes out from the auto slide-stop 13 and the pulley 14 to wind around the curtain body 20. By pulling the rope 31, the curtain body 20 will drive the rope 32 to control the curtain body 20 so that the curtain body 20 can be wound upwards or released downward for shielding light.

Figure 5:
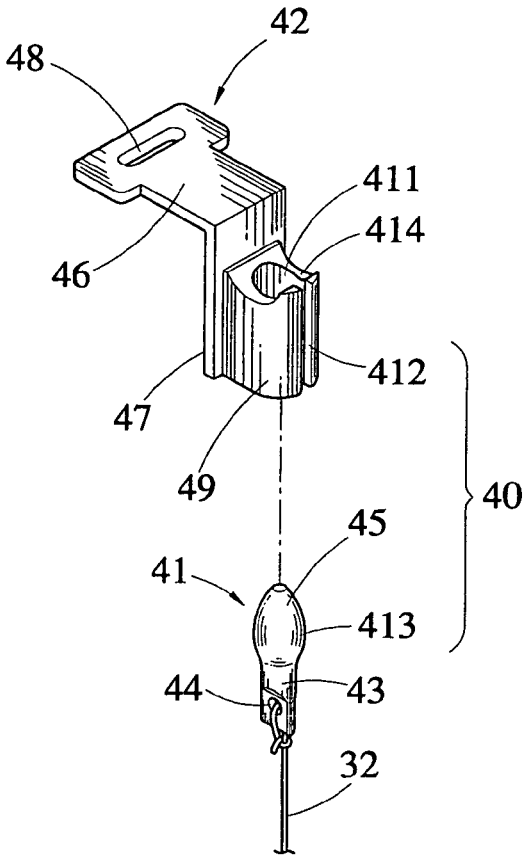
FIG. 5 to 7 is the exploded perspective view, assembled perspective view and cross section view of the safety buckle of the present invention.
Figure 6:
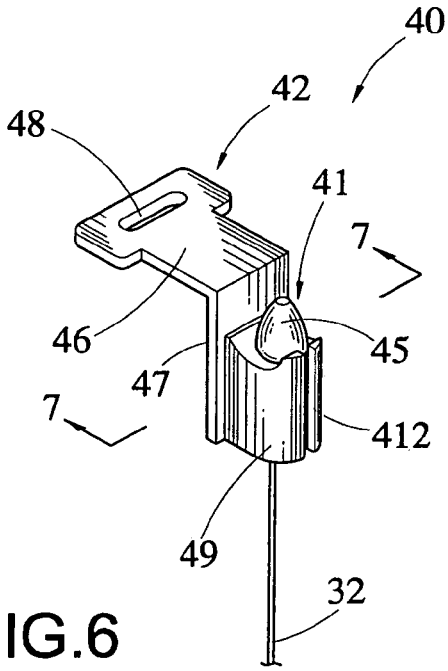
Figure 7:
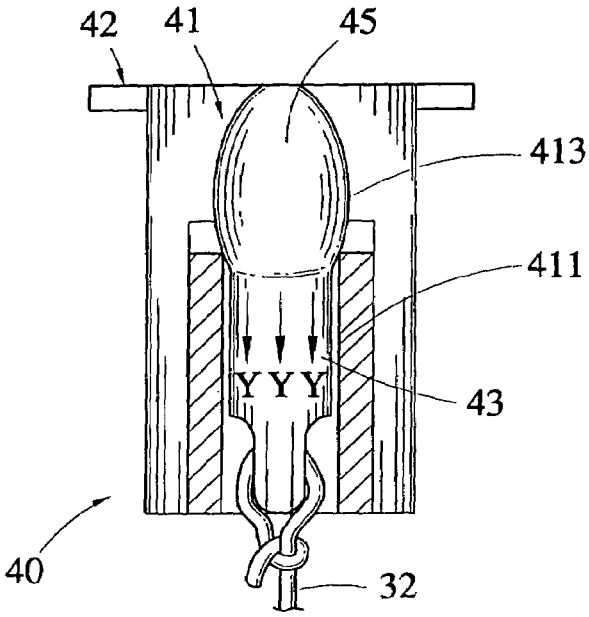
Figure 8:
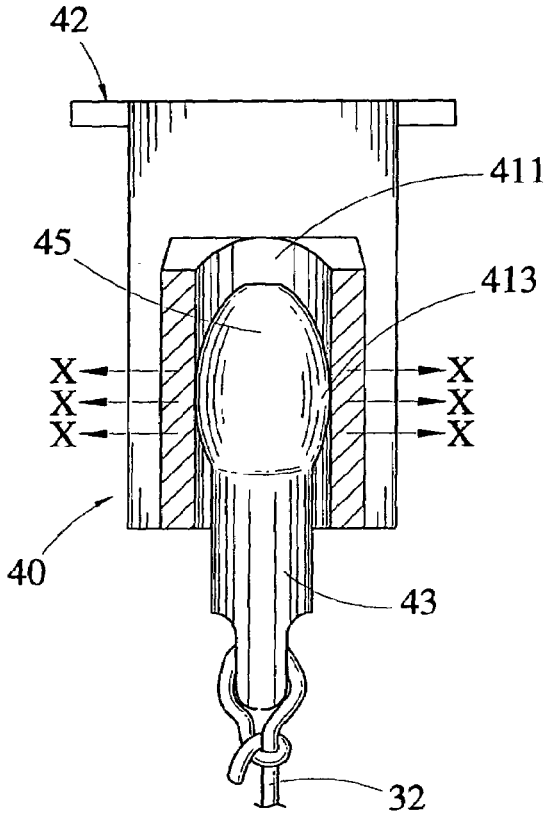
FIG. 8 is a cross-section view showing that the male pin is inserted into the male pin according to the present invention.

With reference to FIGS. 5 to 7, one embodiment about the safety buckle 40 of the present invention is illustrated. The safety buckle 40 includes a male pin 41 and a female pin 42. The male pin 41 has a body portion 43 and a guide end 45 which has a dome shape. A distal end of the rope 32 is firmly secured with a penetrating hole 44 of the body portion 43 so that the male pin 41 is connected to the distal end of the rope 32. The guide end 45 is integral formed with the body portion 43.

The male pin 41 has a first supporting sheet 46 and a second supporting sheet 47. The first supporting sheet 46 has a long hole 48. The stopper 16 can be coupled with the long hole 48 so that the safety buckle 40 is connected to the upper beam 10, as shown in FIG. 3. The second supporting sheet 47 is combined to a pin seat 49. The pin seat 49 has a hollow guide hole 411 and an open groove 412 which is communicable to the hollow guide hole 411. The pin seat 49 and second supporting sheet 47 is integrally formed with the first supporting sheet 46.

The guide end 45 has a middle portion 413 which has a size larger than that of the female pin 42. The diameter of the body portion 43 is slightly smaller than the diameter of the hollow guide hole 411. Therefore, the male pin 41 applies a push force to the body portion 43 so that the guide end 45 is inserted into the hollow guide hole 411 of the female pin 42 until the guide end 45 of the male pin 41 protrudes out of the hollow guide hole 411 of the male pin 41, as shown in FIG. 6. Finally, the outer surface of the guide end 45 is buckled to the opening 414 of the pin seat 49.

When the guide end 45 is inserted into the hollow guide hole 411 of the pin seat 49, the hollow guide hole 411 is extruded by the middle portion 413 so that the pin seat 49 suffers from a pressure as illustrated by the arrow "X". Therefore, by the function of the open groove 412, the hollow guide hole 411 will cause that the diameter of the pin seat 49 enlarges so that the guide end 45 passes through the hollow guide hole 411. Since the pin seat 49 has a sufficient clamping force, the guide end 45 is buckled to the hollow guide hole 411 so that the male pin 41 slides out from the hollow guide hole 411 of the female pin 42.

When the rope 32 is pulled by a force over 3 KG, the male pin 41 and female pin 42 of the rope 32 will separate from one another. This is because the guide end 45 on the male pin 41 moves downward due to a pull force indicated in the "Y" of FIG. 7. As a result, the hollow guide hole 411 is extruded transversally by the middle portion 413. As a result, the guide end 45 of the male pin 41 slides out from the hollow guide hole 411 of the male pin 41. As a result, the rope 32 is separated from the upper beam 10 so as to prevent an accident from occurring. Thereby, the present invention provides a preferred safety structure.

Figure 9:
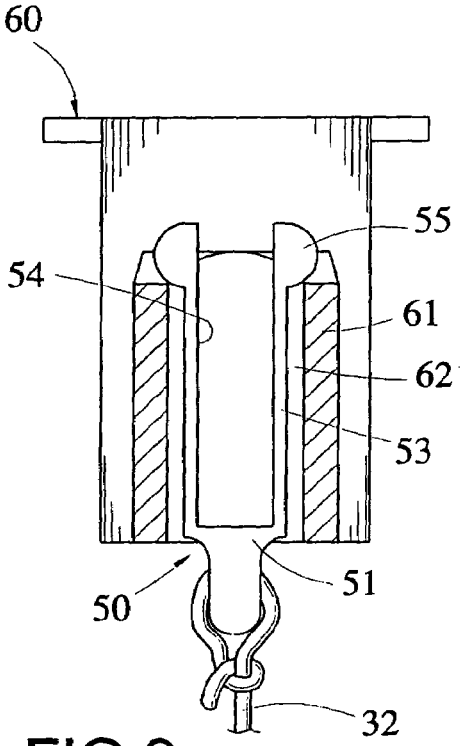
FIG. 9 shows the safety buckle in the second preferred embodiment of the present invention, where a cross section view is illustrated, in that a male pin is inserted into a female pin.

Referring to FIG. 9, the second preferred embodiment of the male pin of the present invention is illustrated, in that a cross section view is shown, where a male 50 is inserted into a female pin 60. The male pin 50 comprises a body portion 51 and a guide end 52. The guide end 52 has two separate connecting arms 53. A space 54 is formed between the two connecting arms 53. The two connecting arms 53 are formed as an elastic element by the space. A top distal end of each connecting end has a protrusion 55. The protrusion 55 can be attached to or separated from a pin seat 61 of the male pin 60.

When the guide end 52 of the male pin 50 is completely inserted into a hollow guide hole 62 of the pin seat 61. A lower end of the protrusion 55 is exactly buckled to the opening 63 of the pin seat 61 so that the male pin 50 is combined to the female pin 60. In insertion, the two separate connecting arms 53 are extruded by the hollow guide hole 62 so that the connecting arms 53 shifts inwards until the protrusions 55 of the connecting arms 53 protrude out of the hollow guide tube 62.

When the rope 22 is pulled by a force over 3 KG, the male pin 50 and the female pin 60 of the rope 32 will separate. This is because when the rope 32 is pulled by a force, the guide end 52 of the male pin 50 will drive the two connecting arms 53 to shift inwards by using the elastic space so that the guide end 52 of the male pin 50 slides out from the hollow guide hole 61 of the female pin 60. Thereby, the rope 32 is separated from the upper beam so as to prevent accident. Thereby, this embodiment provides an optimum safety structure.

The present invention is suitable for longitudinal folding structure, such as winding curtain, transversal Venetian shades, etc.

The present invention is thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A safety buckle of a curtain comprising a curtain body and an upper beam, a distal end of the curtain body being connected to the upper beam; an auto slide-stop being installed within the upper beam for controlling the curtain body to a predetermined position; and a control rope set having a first end and a second end which are at opposite sides; the first end being a rope and the second end being also a rope which are interacted so as to control the curtain body to be folded upwards or to be released downward; the safety buckle comprising:

a male pin having a body portion and a guide end; the body portion being positioned at a bottom of the solid guide end and being connected to a distal end of the rope; and a female pin firmly secured to the upper beam and having a pin seat; the pin seat being formed with a hollow guide hole; a diameter of the hollow guide hole being smaller than a diameter of the solid guide end of the male pin for enforcing the solid guide end of the male pin to be inserted into the hollow guide hole so as to be combined with the pin seat; when the ropes of the control rope set are pulled, the male pin is separated from the female pin so that the upper beam and the ropes are in a safe state, wherein the hollow guide hole has an open groove so that when the guide end of the male pin passes through the hollow guide hole, a substantially equal force is exerted by the solid guide end on the pin seat causing substantial deformation of the pin seat and negligible deformation of the solid guide end.

2. The safety buckle of a curtain as claimed in claim 1, wherein if the force for pulling the ropes is over 3 KG, the solid guide end of the male pin slides out of the hollow guide hole of the female pin.

3. The safety buckle of a curtain as claimed in claim 1, wherein the solid guide end of the male pin has a taper shape.

4. The safety buckle of a curtain as claimed in claim 1, wherein a guide end of a male pin has two separate connecting arms; a space is formed between the two connecting arms; the two connecting arms are formed as an elastic element through the space; a top distal end of each connecting arm has a protrusion; the protrusion is attached to a pin seat of the male pin.

* * * * *